United States Patent [19]

Cook

[11] Patent Number: 4,880,158

[45] Date of Patent: Nov. 14, 1989

[54] SURFACE GRADE CROSSING STRUCTURE

[76] Inventor: Louis V. Cook, c/o Anderson Cook Enterprises, P.O. Box 656, Mundelein, Ill. 60060

[21] Appl. No.: 125,706

[22] Filed: Nov. 27, 1987

[51] Int. Cl.[4] ..... E01B 2/00

[52] U.S. Cl. ..... 238/8

[58] Field of Search ..... 238/8, 2, 3, 5, 6, 7, 238/9, 381, 379

[56] References Cited

U.S. PATENT DOCUMENTS

| | | | |
|---|---|---|---|
| 1,191,561 | 7/1916 | Burns | 238/8 |
| 1,279,062 | 9/1918 | Winter | 238/8 |
| 2,828,079 | 3/1958 | Rennels | 238/8 |
| 3,056,555 | 10/1962 | Eisses | 238/8 |
| 3,825,184 | 7/1974 | Hartl | 238/8 |
| 3,843,051 | 10/1974 | Whitlock | 238/8 |
| 3,866,830 | 2/1975 | Hein et al. | 238/8 |
| 4,009,827 | 3/1977 | Tafel | 238/8 |
| 4,093,120 | 6/1978 | Canfield | 238/8 |
| 4,117,977 | 10/1978 | Whitlock | 238/8 |
| 4,169,688 | 10/1979 | Toshio | 404/40 |
| 4,203,547 | 5/1980 | Van der Harst | 238/8 |
| 4,267,969 | 5/1981 | Hales et al. | 238/8 |
| 4,289,273 | 9/1981 | Schmidt | 238/8 |
| 4,365,743 | 12/1982 | Trickel et al. | 238/8 |
| 4,368,845 | 1/1983 | Perry et al. | 238/8 |
| 4,421,272 | 12/1983 | Whitlock | 238/8 |
| 4,445,640 | 3/1984 | Caillet | 238/8 |
| 4,461,421 | 7/1984 | Maass | 238/8 |
| 4,545,527 | 10/1985 | Young | 238/8 |
| 4,732,320 | 3/1988 | Owen | 238/8 |

OTHER PUBLICATIONS

Catalog-Omni Rubber Products, Inc.-Shimless Rubber Railroad Crossings.

Goodyear Tire Rubber and Company, Rubber Company, Rubber Crossings for Highways, Jul. 1985, pp. 3,8 and 9.

Catalog-Structural Rubber Products Company-Saf&-Dri Model-C Rubber Grade Crossing.

Catalog-Red Hawk Rubber Co., Inc.

Catalog-Derflusternde Bahnubergang.

Catalog-Parkco Rubber Railroad Crossings.

Catalog-Cobra X.

Catalog-FAB-RA-CAST.

*Primary Examiner*—Johnny D. Cherry
*Assistant Examiner*—Joseph D. Pape
*Attorney, Agent, or Firm*—Wood, Dalton, Phillips Mason & Rowe

[57] ABSTRACT

A surface grade crossing structure comprising a series of flat rubber pads, each pad having a notch in the bottom to allow for easy installation. Adjacent pads are joined to each other by a key and keyway. Clips are placed in the keyway and secured in the railroad tie. The lower surface of the outer edges of each pad has a series of anchor reliefs which accommodate rail anchors at the base of the rail. The pads may be trapezoidal to accommodate both tangent and curved tracks.

14 Claims, 2 Drawing Sheets

FIG. 1
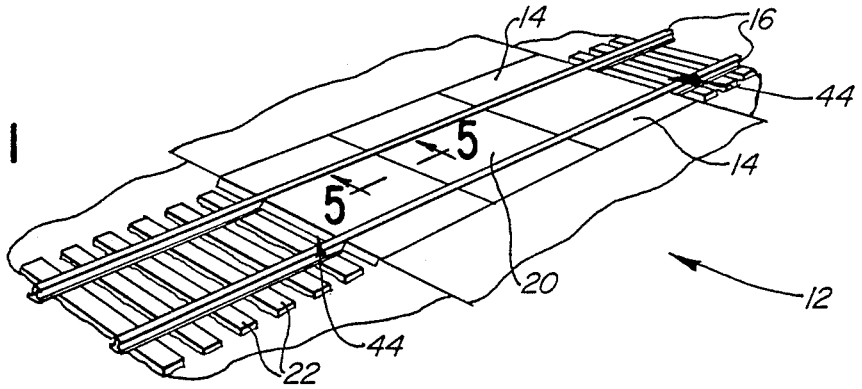
FIG. 2
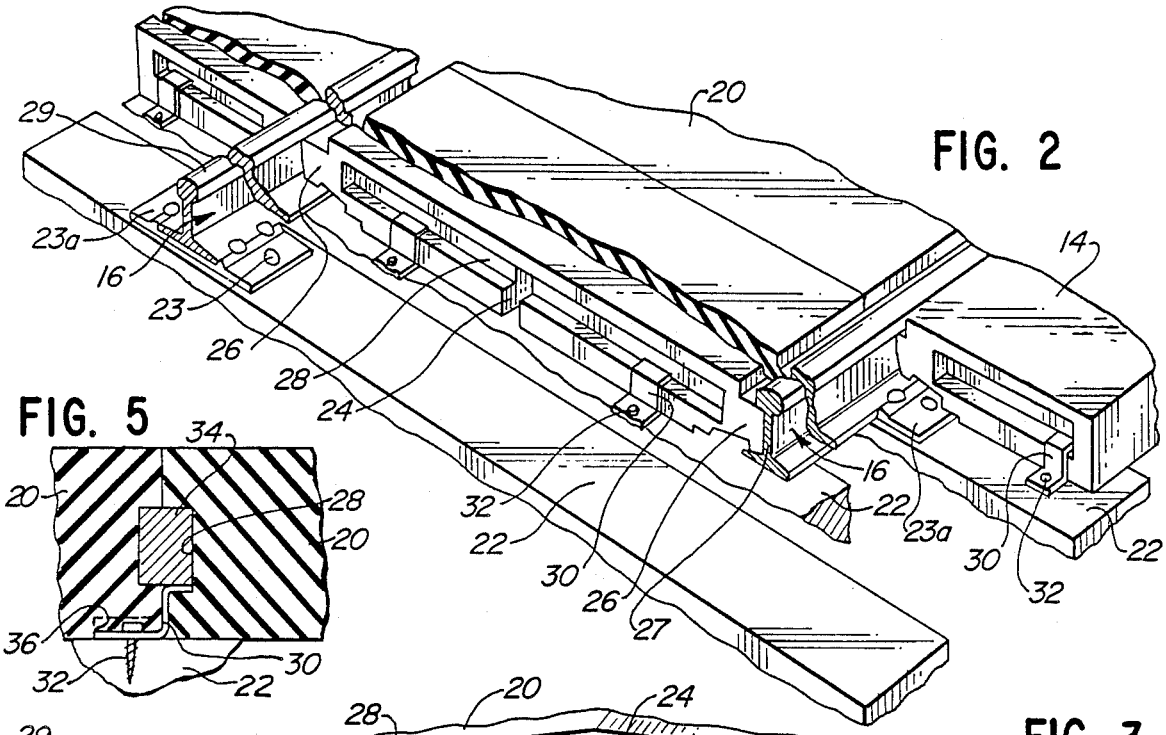
FIG. 5
FIG. 3
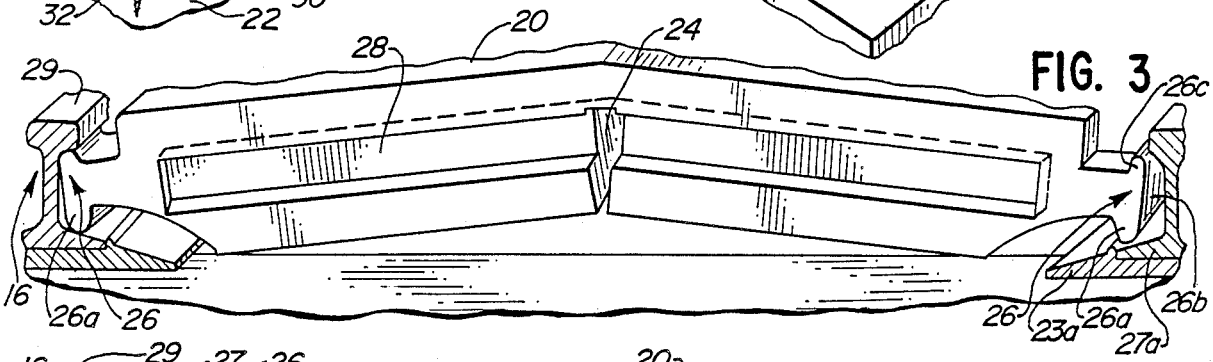
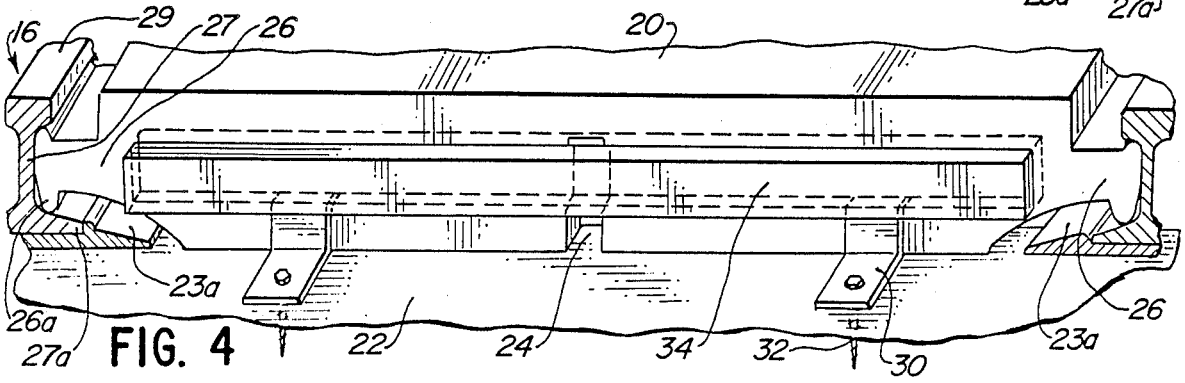
FIG. 4

FIG. 6
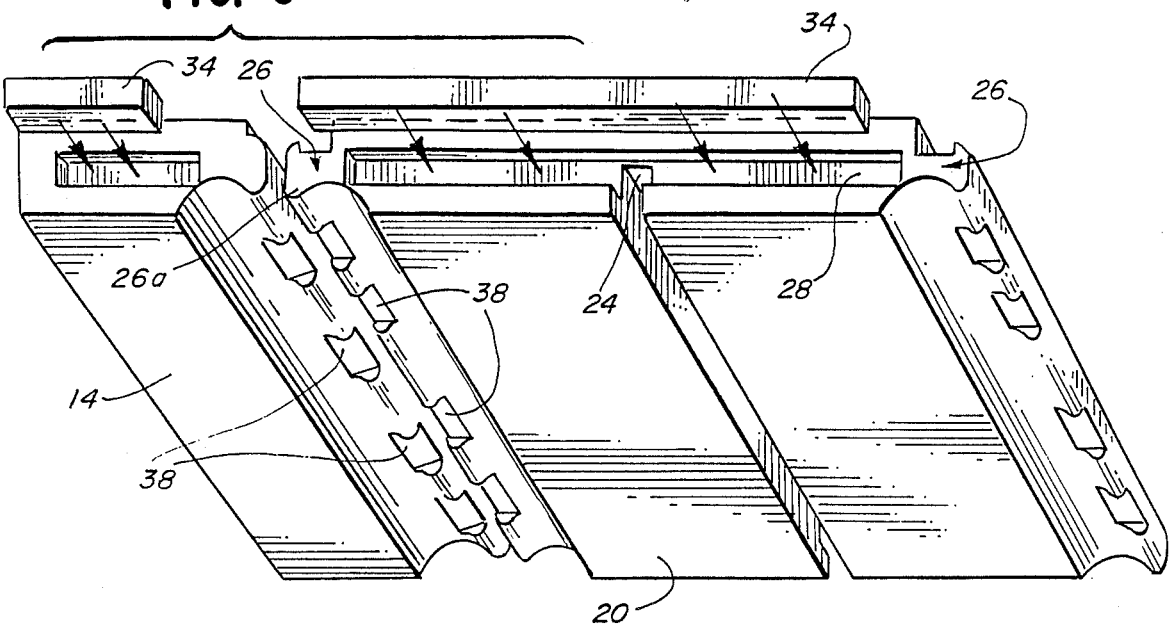
FIG. 7
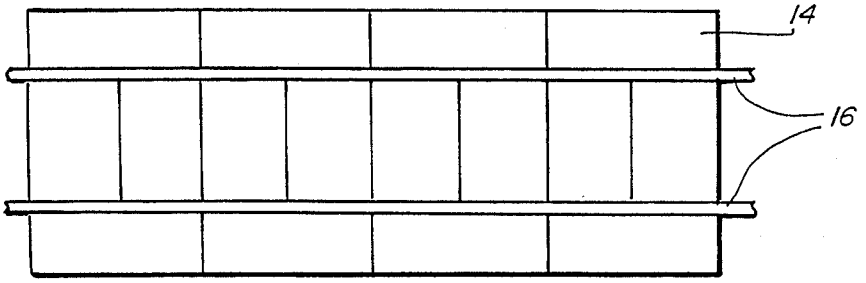
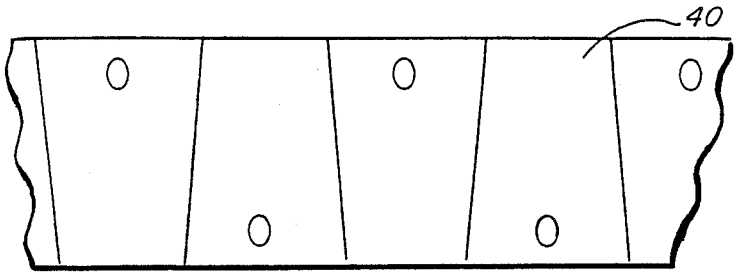
FIG. 8
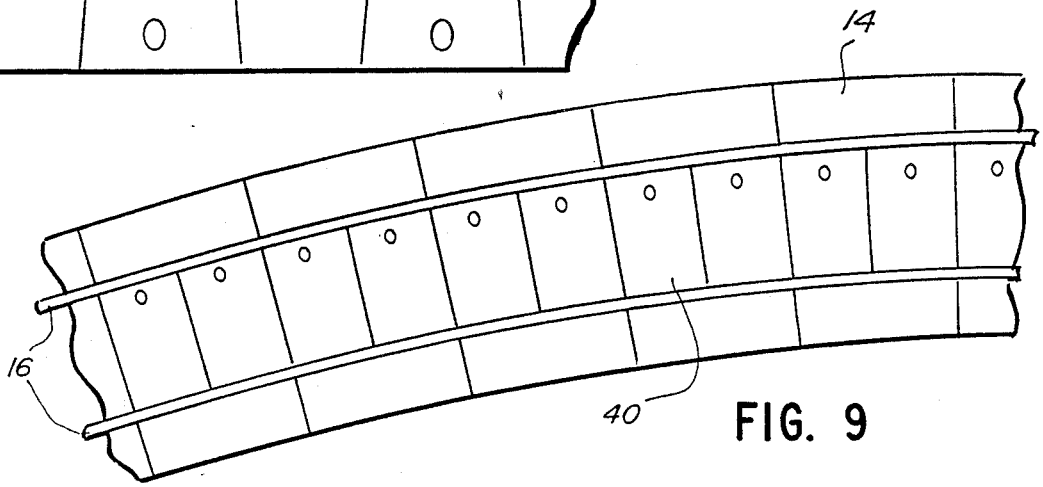
FIG. 9

SURFACE GRADE CROSSING STRUCTURE

BACKGROUND OF THE INVENTION

This invention relates to an improved surface grade railroad crossing structure.

One prior art structure is exemplified in U.S. Pat. No. 4,093,120, which discloses a railroad crossing structure having a gauge structure (located between the rails) consisting of two separate pads. Two pads are required in order to properly install the structure between the ties. Manufacture of two separate pads, however, necessarily involves an increase in manufacturing costs and thereby a corresponding increase in cost. Also, two pad structures become uneven at their center juncture, thereby creating a crack through which moisture may enter and be retained, resulting in deterioration of the substructure and ties.

Another prior art structure is exemplified by U.S. Pat. No. 4,289,273, which discloses a railroad crossing structure including pads of widely varying shapes to be used in the vicinity of track switches, frogs and intersections. Each of these pads must be individually manufactured since each pad is sized to fit a particular section of the track. Installation thereof is also greatly complicated since each of the pads must be identified with a corresponding section of rail.

In addition to the above problems is a difficulty in the prior art with adequately securing pads to prevent lateral and vertical movement, resulting in grade crossing structures which are not solid and unitary and which do not block water and debris and filtration into the railroad bed.

The present invention is directed toward overcoming one or more of the problems as set forth above.

SUMMARY OF THE INVENTION

In one aspect of the present invention, a surface grade crossing structure is provided having a series of pads wherein each flat rubber pad includes a notch in the bottom of the pad, located between and parallel to the rails and extending the full length of the pad.

In another aspect of the present invention, each pad includes a keyway located at each end of the pad and extending nearly to the width of the pad. A key of the same length and thickness as the keyway is inserted into the keyway.

In yet another aspect of the present invention, the pads include a series of anchor reliefs located on the lower surface of the outer edges of the pad to accommodate the rail anchors at the base of the rail.

In still another aspect of the present invention, clips are used in the installation of each pad to secure the pads to the ties.

In a further aspect of the present invention, the pads are trapezoidal with one side shorter than the other side.

The improved surface grade crossing structure of the present invention is inexpensive, easy to install and maintain, and provides for a stable, monolithic structure.

The present invention thus provides a crossing structure wherein each pad may be easily installed, without requiring special tools or accessories such as shims, header boards, lag screws, support blocks and cables.

The present invention also provides a crossing structure which is secure against lateral and vertical movement, and which also prevents water and debris infiltration into the railroad bed.

Furthermore, the present invention provides for a crossing structure wherein each pad may be used to accommodate both straight, parallel tracks and curvilinear tracks.

BRIEF DESCRIPTION OF THE DRAWINGS

FIG. 1 is a perspective view illustrating a railroad crossing structure exemplary of the present invention;

FIG. 2 is a partially broken perspective view of the railroad crossing structure;

FIG. 3 is a perspective view illustrating the elastomeric pad during installation;

FIG. 4 is perspective end view illustrating the elastomeric pad when installed;

FIG. 5 is a cross-sectional view illustrating two pads installed end to end, taken generally along line 5—5 of FIG. 1;

FIG. 6 is a bottom perspective view of the field and gauge pads of the present invention;

FIG. 7 is a top view of a crossing incorporating the pads of the present invention;

FIG. 8 is a top view illustrating exaggerated trapezoidal pads of the present invention; and FIG. 9 is a top view of a curved track incorporating the elastomeric trapezoidal pad of the present invention.

DESCRIPTION OF THE PREFERRED EMBODIMENTS

The railroad crossing 12 shown in FIG. 1 is surfaced by a plurality of field pads 14 on the outside of the rails 16, and gauge pads 20 inside the rails 16. The rails 16 are supported by a plurality of ties 22 and are secured thereto by spikes 23 passing through tie plates **23*a* (see FIG. 2**).

The elastomeric pads 14, 20 can be molded from rubber or other material and are of rectangular or trapezoidal shape, as will be explained later.

The gauge pad 20 would typically be a 3 foot, 3 inch long modular unit, molded to the desired gauge of the railroad (standard, wide or narrow gauge) with its thickness determined by the height of the rail used in the particular crossing 12. The 3 foot, 3 inch unit will accommodate standard 19½ inch center to center spacing of wood ties.

The field pad 14 would typically be a 6 foot 6 inch long modular unit, molded in widths to accommodate the length of the ties 22 with the outer edge of the pad 14 aligned with the end of the ties 22.

The gauge pad 20 has a notch 24 in its bottom, substantially parallel to and preferably centered between its opposite edges or sides 26 which engage the web portion 27 of the rails 16. It should be noted that the notch 24 does not have to be centered but should be between edges 26 at a location to assist installation of the pad 20 between the rails 16. The notch 24 allows a full width of pad 20 extending between rails 16 to be installed while providing edges 26 shaped to engage rail webs 27, a portion of rail base 27a and a portion of the rail head 29. Particularly in FIG. 3, the edge 26 is shaped to provide a portion **26*b* engaging the web 27, a separate foot 26*a* engaging the rail base 27*a* to support the pad 20 adjacent the rail 16 and a portion 26*c* engaging under the rail head 29**.

The gauge pad 20 has a keyway 28 located at each end. Z clips 30 having one end in the keyway 28 are secured on the other end to the top of the tie 22 by a screw 32 or the like to hold the pad 20 down on the ties 22.

The field pad 14 also has a keyway 28 and is secured to the ties 22 by a Z clip 30.

FIG. 3 shows the gauge pad 20 as it is being installed with its flexible upper portion bent so that the notch 24 is closed. FIG. 4 shows the gauge pad 20 installed (with the notch 24 open and the opposite edges 26 abutting the web portion 27 of the opposing rails 16), and with a key 34 in the keyway 28, ready for installation of the next adjacent pad. The key 34 is of substantially the same length and thickness as the keyway 28.

Installation of an adjacent or adjoining pad 20 or pad 14 is shown in FIG. 5. The adjoining pads are interlocked by the key 34 in matching keyways 28 in both pads 20. As shown in FIG. 5, clip recesses 36 may be located on the bottom of the pads 20 to allow for the securing clips 30.

As shown in FIG. 6, anchor reliefs 38 may be located in the bottom of the opposite edges 26 of both the field pad 14 and the gauge pad 20 to accommodate the rail anchors (not shown).

Arrangement of the pads 14, 20 in a typical crossing is illustrated in FIG. 7.

In the preferred method of installation, the gauge pad 20 is lowered between the opposite rails 16, as depicted in FIG. 3. Bending or hinging the pad 20 so that the notch 24 is closed causes the opposite edges 26 to be drawn toward each other to allow the gauge pad 20 to pass between the rail head 29 of the rails 16. Once the gauge pad 20 has been situated, it may be lowered into position as shown in FIG. 4, which will open the notch 24 to force the opposite edges 26 against the web portions 27 of the rails 16. Once the gauge pad 20 is flat on the ties 22, the clip 30 is located inside the keyway 28 and secured to the tie 22.

The key 34 is then placed in the keyway 28. The next adjoining pad 20 may then be located between the rails 16 and slid laterally to interlock with the already secured pad 20 as shown in FIG. 5. The key 34 and keyway 28 insure an even transition between the adjacent pads 20 and a flat plane across the top of the crossing structure. Preferably, the top surface of the pads 20 are made to rest in a plane about a quarter of an inch above the rail heads 29, however any planar surface from even to a quarter of an inch above the rail heads 29 are to be considered satisfactorily coplanar with the rail heads 29. The monolithic structure effected by the key 34 and keyway 28 also blocks water and debris infiltration into the railroad bed.

The lateral movement of an adjoining pad 20 (or pad 14), to effectuate keying, is made possible by the anchor reliefs 38 in the opposite edges 26 of the gauge pads 20 and in the web engaging edge of the field pads 14. These reliefs 38 are spaced to fit over standard rail anchors (not shown) and are long enough to allow sliding of the pads 14, 20 to close the keys 34 into the keyway 28. Additionally, as depicted in FIG. 5, lateral movement over the clips 30 is allowed by the clip recesses 36.

Once the pads 20 are in place, end blocks (not shown) are forceably jacked against the pads 20 at the lateral ends 44 of the crossing shown in FIG. 1, to force the pads 20 together and to close up all spaces between them. The end blocks are then secured to the ties 22 to provide for a monolithic structure. The field pads 14 can be made in two lengths to accommodate the difference in length between the inside and outside of a curved track and alternated for straight track intersections (see FIGS. 7 and 9).

In a further embodiment of the present invention, as depicted in FIGS. 8 and 9, the pads 40 of the railroad crossing structure are trapezoidal. Such pads 40 may be used with a straight or tangent track by simply alternating the direction of the wedge shape of the trapezoidal pad 40, as shown in FIG. 8, so that the angles thereof offset each other. Trapezoidal pads 40 having the notch, key and keyway as previously described may easily be alternated as shown.

It should be understood that the trapezoidal shape of the pads 40 illustrated in FIG. 8 is exaggerated for purposes of illustration. A typical size pad 40 would have one edge 39-3/16 inches long with the opposite edge only 38-13/16 inches long.

Such pads 40 can thus be used in not only straight crossings, but also in crossings having rails with different degrees of curvature. For example, for maximum curvature, each pad 40 would be positioned with its short edge toward the curve center as shown in FIG. 9. With lesser degrees of curvature, the pads 40 could be appropriately alternated, with every third, or fourth, etc. pad 40 positioned with its long edge toward the curve center.

Such interchangeability results in tremendous cost savings since the trapezoidal pads 40 may be used to accommodate a straight track or various curved tracks without requiring that special sized pads be made for each track configuration.

All of these features result in a railroad crossing structure which is low cost, easy to install, easy to maintain, and has a long life.

Other aspects, objects and advantages of the invention can be obtained from a study of the drawings, the specification, and the appended claims.

I claim:

1. A surface grade crossing structure for use with a railway track consisting of a pair of spaced, parallel rails, each rail having a base, a web portion, and a rail head, said rails being secured on a plurality of spaced, elongated ties situated perpendicular to said rails and each having an upwardly facing substantially planar surface, said surface grade structure comprising:

a unitary pad of solid elastomeric material with an upper substantially planar surface and a lower substantially planar surface adapted to facially engage the upwardly facing surface of the ties with the pad upper surface substantially coplanar with the heads of said rails, said pad further having opposite parallel edges which, with the pad operatively positioned between the spaced rails, are spaced apart a distance greater than the spacing between the rail heads, and a single notch means in the pad for permitting folding of two portions of the pad relative to each other sufficiently without said two portions bending to reduce the effective spacing between the opposite parallel pad edges so that with the one parallel edge adjacent the web portion on one rail the other parallel edge can be lowered beneath the head on the other rail without interference between the other parallel edge and other rail head whereupon the pad can be relaxed to bear the lower pad surface facially against the upwardly facing tie surfaces.

2. A surface grade crossing structure for use with a railway track consisting of a pair of spaced, parallel rails, each rail having a base, a web portion, and a rail head, said rails being secured on a plurality of spaced, elongated ties situated perpendicular to said rails, said surface grade crossing structure comprising:

a unitary pad of solid elastomeric material adapted to rest on the upper surface of the ties and upon the rail bases with the pad upper surface coplanar with the head of said rail, said pad further having opposite parallel edges spaced apart a distance at least equal to the spacing between the rail web portions of the track, and a single notch in the pad bottom substantially parallel to and located between the opposite edges, said notch allowing the unitary pad to be folded during installation thereof;

wherein said pad further includes a keyway located at each end of said pad and extending across at least a portion of the width of said pad, a clip securable at one end to the interior of the keyway and at the other end to the tie, a key receivable in said keyway once said clip has been secured to said keyway and said tie, said key being of substantially the same length and height as said keyway to effectuate keying.

3. The surface grade crossing structure of claim 2, wherein each key is received in the keyway of an adjacent pad to create a monolithic structure.

4. The surface grade crossing structure of claim 2, wherein said edges of said pad contain a series of rail anchor reliefs, said reliefs allowing sliding of said pads to close said keys into said keyways.

5. A surface grade crossing structure for a railway track, said track consisting of a pair of spaced, parallel rails, each rail having a base, a web portion, and a rail head, said rails being secured on a plurality of spaced, elongated ties situated perpendicular to said rails and each having an upwardly facing substantially planar surface, said surface grade crossing structure comprising:

a plurality of unitary pads of solid elastomeric material each having an upper substantially planar surface and a lower substantially planar surface adapted to facially engage the upwardly facing surface of the ties with the upper pad surfaces coplanar with the heads of said rails, each of said pads further having opposite parallel edges which, with the pad operatively positioned between the spaced rails, are spaced apart a distance greater than the spacing between the rail heads, a keyway located at each end of each pad and extending the width of each pad, and a single notch means in the bottom of each pad for permitting folding of two portions of each pad relative to each other sufficiently without said two portions bending to reduce the effective spacing between the opposite parallel pad edges so that with the one parallel edge adjacent the web portion on one rail the other parallel edge can be lowered beneath the head on the other rail without interference between the other parallel edge and other rail head whereupon each pad can be relaxed to bear its lower pad surface facially against the upwardly facing tie surfaces.

6. The surface grade crossing structure of claim 5, further comprising a key receivable in the keyways of adjacent pads to define a monolithic structure.

7. The surface grade crossing structure of claim 5, wherein said edges of said pads contain a series of rail anchor reliefs. said reliefs allowing sliding of said pads to close keys into said keyways.

8. A surface grade crossing structure for a railway track, said track consisting of a pair of spaced, parallel rails, each rail having a base, a web portion, and a rail head, said rails being secured on a plurality of spaced, elongated ties situated perpendicular to said rails, said surface grade crossing structure comprising:

a plurality of unitary pads of solid elastomeric material adapted to rest on the upper surface of the ties with their upper surface coplanar with the head of said rail, each of said pads further having opposite parallel edges spaced apart a distance at least equal to the spacing between the rail web portions of the track, a keyway located at each end of each pad and extending the width of each pad, and a single notch in the bottom of each pad substantially parallel to and located between the opposite edges, said notch allowing the pad to be folded during installation thereof; said surface grade crossing structure further comprising clips securable to the keyways and said ties.

9. A surface grade crossing structure for use with a railway track, said track consisting of a pair of spaced, parallel rails, each rail having a base, a web portion, and a rail head, said rails being secured on a plurality of spaced elongated ties situated perpendicular to said rails and each having an upwardly facing substantially planar surface, said surface grade crossing comprising:

a plurality of identical elastomeric trapezoidal pads each having an upper substantially planar surface and a lower substantially planar surface adapted to facially engage the upwardly facing surface of the ties with the upper pad surfaces coplanar with the heads of said rails, said pads each further having opposite parallel edges which, with the pad operatively positioned between the spaced rails, are spaced apart a distance greater than the spacing between the rail heads, a keyway located at each end of each pad and extending the width of each pad, and a single notch means in the bottom of each pad for permitting folding of two portions of each pad relative to each other sufficiently without said two portions bending to reduce the effective spacing between the opposite parallel pad edges so that with the one parallel edge adjacent the web portion on one rail the other parallel edge can be lowered beneath the head on the other rail without interference between the other parallel edge and other rail head whereupon each pad can be relaxed to bear its lower pad surface facially against the upwardly facing tie surfaces.

10. The surface grade crossing structure of claim 9, wherein the orientation of said trapezoidal pads is selectively alternated in accordance with the curvature of the railway track.

11. The surface grade crossing structure of claim 9, wherein said pads further include a keyway located at each end of each pad and extending the width of each pad.

12. The surface grade crossing structure of claim 11, further comprising keys receivable in the keyways of adjacent pads to define a monolithic structure.

13. The surface grade crossing structure of claim 11, further comprising clips securable to the keyways and the ties.

14. The surface grade crossing structure of claim 9, wherein said edges of said pads contain a series of rail anchor reliefs, said reliefs allowing sliding of said pads to close keys into said keyways.

* * * * *